US011384557B2

(12) United States Patent
Duffaut et al.

(10) Patent No.: US 11,384,557 B2
(45) Date of Patent: Jul. 12, 2022

(54) SYSTEMS AND METHODS OF OPERATING AUTOMATIC SWIMMING POOL CLEANERS

(71) Applicant: Zodiac Pool Care Europe, Bron (FR)

(72) Inventors: Simon Duffaut, Castelginest (FR); Arnaud Lancry, Le Vernet d'Ariege (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 149 days.

(21) Appl. No.: 16/903,668

(22) Filed: Jun. 17, 2020

(65) Prior Publication Data

US 2020/0407996 A1 Dec. 31, 2020

Related U.S. Application Data

(63) Continuation of application No. 62/868,176, filed on Jun. 28, 2019.

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS

| | | | | |
|---|---|---|---|---|
| 5,569,371 | A * | 10/1996 | Perling | E04H 4/1654 15/1.7 |
| 10,209,719 | B2 * | 2/2019 | Hadari | G05D 1/0016 |
| 2002/0046817 | A1 * | 4/2002 | Last | E04H 4/101 160/133 |
| 2019/0101394 | A1 * | 4/2019 | van der Meijden | G05D 1/0088 |

FOREIGN PATENT DOCUMENTS

| | | |
|---|---|---|
| EP | 3199725 | 8/2017 |
| WO | 2017216784 | 12/2017 |

OTHER PUBLICATIONS

International Application No. PCT/IB2020/055663, International Search Report and Written Opinion dated Sep. 22, 2020, 10 pages.
International Application No. PCT/IB2020/055663, International Preliminary Report on Patentability dated Jan. 6, 2022, 7 pages.

* cited by examiner

*Primary Examiner* — Michael D Jennings
(74) *Attorney, Agent, or Firm* — Kilpatrick Townsend & Stockton LLP

(57) ABSTRACT

A swimming pool cleaner may include motive elements intentionally driven in an unbalanced manner. This unbalanced driving may allow a cleaner to maintain contact with ("hug") walls of a pool, allowing the cleaner to, e.g., obtain information allowing mapping of the pool perimeter.

7 Claims, 1 Drawing Sheet

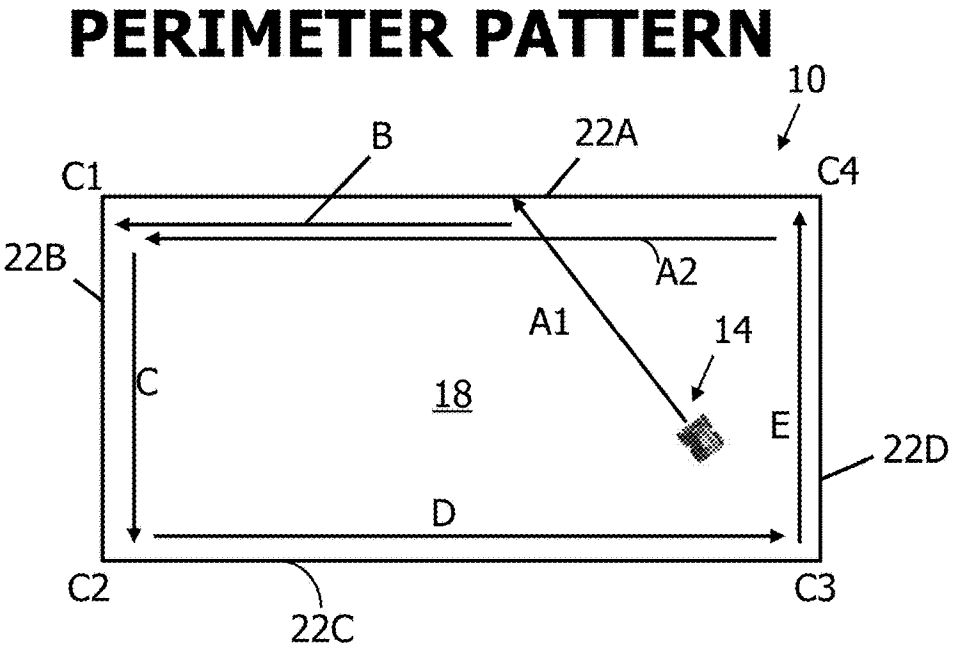
Routine
Repeat X times :
1. Cleaner searches a wall
2. Short wall extraction
3. Rotation close to right angle (less to join wall quickly)
Note
During wall research phase traction speeds are unbalanced to keep contact with wall (more speed on opposite side and less on wall side)

SYSTEMS AND METHODS OF OPERATING AUTOMATIC SWIMMING POOL CLEANERS

CROSS-REFERENCE TO RELATED APPLICATION

This application claims the benefit of and priority to U.S. Provisional Patent Application Ser. No. 62/868,176, filed Jun. 28, 2019, the entire contents of which are hereby incorporated herein by this reference.

FIELD OF THE INVENTION

This invention relates to cleaning devices for water-containing vessels such as swimming pools and spas and more particularly, although not necessarily exclusively, to autonomous swimming pool cleaners whose traction speeds may be unbalanced intentionally to assist the cleaners in outlining perimeters of their associated pools.

BACKGROUND OF THE INVENTION

Automatic swimming pool cleaners (APCs) are well known. These cleaners often are categorized as either "hydraulic" or "robotic" (or "electric"), depending on the source of their motive power. Hydraulic cleaners, for example, typically use pressurized (or depressurized) water to effect their movement within pools, whereas robotic cleaners typically utilize an electric motor to cause their movement. Moreover, hydraulic cleaners frequently are sub-categorized as either "pressure-side" or "suction-side" devices, with pressure-side cleaners receiving pressurized water output from an associated water-circulation pump and suction-side cleaners, by contrast, being connected to an inlet of the pump.

Electric motors of robotic cleaners may drive wheels, tracks, or any other suitable mechanisms. If tracks are employed, one track normally is used on each of the left and right sides of a robotic APC. If wheels are utilized, conventionally two (front and rear) are utilized on each of the left and right sides of the robotic APC, with either the two front or the two rear wheels (or all four wheels) being driven. Shafts, gears, and other standard components may connect the wheels or tracks to the drive motor(s).

Typically, tracks or wheels on the left and right sides of a robotic APC are driven at the same speed. Doing so allows the cleaner to travel generally in a forward or rearward direction. Various techniques may be used to cause the robotic APC to reorient its body within a swimming pool and thus change the direction of movement.

Value exists in determining sizes and shapes of swimming pools in which APCs operate. Mapping a perimeter of the floor of a pool, furthermore, may be especially advantageous. Knowing the floor perimeter may facilitate determination of the location of the APC as it traverses a pool, for example. The floor perimeter additionally may be used to calculate, or at least estimate, an area of the bottom surface to be cleaned, potentially optimizing the amount of time the APC is activated for operation.

SUMMARY OF THE INVENTION

The present invention seeks to provide systems and methods for mapping, e.g., pool perimeters. No external cameras or measurement tools are needed, moreover, to obtain useful information. Instead, an APC operating within a pool may itself be used to conduct the mapping.

In particular, once a body of a robotic APC is deemed to have contacted a vertical wall of a pool, traction speed of the track or wheels on one side of the body is altered in a manner tending to drive a side of the body into the wall. Employing unbalanced traction speeds on sides of the APC helps maintain the body in contact with the wall as it travels generally linearly along the wall, permitting measuring of the linear distance travelled by the cleaner.

If the pool has a rectangular portion, eventually the cleaner will reach a corner of the pool at which two vertical pool walls join at a right (~90°) angle. At this point, the APC may effect a turn in any suitable manner so as to continue to travel generally linearly along the wall. After the turn occurs, the APC again is operated at unbalanced traction speeds so as to maintain contact with the wall as the cleaner travels linearly along it.

If the pool is wholly rectangular, the robotic APC will have traversed the entire perimeter of the pool after four, and before five, turns have occurred. Consequently, after four turns, the APC will have traversed at least part of the length of a first wall of the pool and the entire length of the remaining three walls of the pool. Repeating the pattern at least once allows the APC to travel along the entirety of the first wall of the pool and to repeat travel along the other walls, allowing the perimeter measurements to be refined.

BRIEF DESCRIPTION OF THE DRAWING

The FIGURE provides a schematic representation of exemplary movement paths of an APC within a swimming pool.

DETAILED DESCRIPTION

The FIGURE schematically illustrates the above-described concept in rectangular pool 10. As shown in the FIGURE, APC 14 operates within pool 10 normally, cleaning floor 18 of the pool 10 and eventually transiting forward along path A1. Transit of path A1 causes the right side of the body of APC 14 to contact vertical wall 22A and turn slightly so as to begin transit along path B. This change of direction may be sensed or otherwise cause a controller of APC 14 to change the relative traction speeds of the motive means on the left and right sides of the body so that the track or wheels on the right side (closer to wall 22A) move at a speed less than the track or wheels on the left side (away from wall 22A) of the body. In this manner, APC 14 effectively is caused to "hug" (maintain contact with) wall 22A as the APC 14 moves linearly along the wall 22A. The linear distance travelled by APC 14 along path B may be sensed or determined using information obtained on-board the cleaner.

Following path B will lead APC 14 to wall 22B in the vicinity of corner C1. APC 14 turns so as to follow path C along wall 22B, with the track or wheels on its right side (closer to wall 22B) continuing to move at a speed less than the track or wheels on its left side (away from wall 22B). APC 14 thus may travel to wall 22C near corner C2, where it turns again to follow path D along wall 22C, thereafter to wall 22D near corner C3, where it turns to follow path E along wall 22D, and thereafter to wall 22A near corner C4, where it turns to follow path A2. Use of unbalanced traction speeds may continue throughout this mapping process.

Clear from the FIG. 1*s* that, after following paths B, C, D, E, and A2, APC 14 will have traversed the entire perimeter of pool 10 (including having retraced its travel along path B). Lengths of each of paths C, D, E, and A2 between turns may be calculated or otherwise determined or sensed in any suitable manner, as may any angular deviations in the paths. Indeed, if pool 10 is not rectangular, angular deviations will be present and thus may be mapped too. Moreover, this travel routine may be repeated any desired number of times to confirm or refine the information obtained.

The unbalanced traction speeds discussed herein likewise may be achieved in any suitable manner. In some versions of APC 14, more than one drive motor may be employed, with the motors operating at different speeds to drive wheels or tracks at different velocities. In other versions of APC 14, a single motor may be geared differently as connected to different tracks or wheels so as to produce different traction speeds. Other techniques recognizable by persons skilled in the art alternatively or additionally may be utilized.

Although the FIGURE schematically illustrates APC 14 travelling generally counterclockwise, persons skilled in the art will recognize that APC 14 may travel generally clockwise instead within pool 10. In such event the controller of APC 14 may change the relative traction speeds of the motive means on the left and right sides of the body so that the track or wheels on the left side move at a speed less than the track or wheels on the right side of the body. As well, rather than changing relative traction speeds to maintain contact with a wall, persons skilled in the art may utilize other methods, such as providing specific sorts of mechanical balancing (or unbalancing) within an APC 14 or changing the pump drive. Additionally, although the FIGURE addresses following pool walls, equally true is that pool rims or other structural aspects of a pool may be followed instead.

Exemplary concepts and combinations of features of the invention may include:

A. A method of causing an automatic swimming pool cleaner having a body substantially to conform its travel to a wall or other structural aspect of a pool.

B. A method according to statement A. in which the body substantially conforms its travel by driving a first motive element on a first side of the body at a different speed than a second motive element on a second side of the body opposite the first side.

C. A method according to statement B. in which (i) the first side of the body is closer to the wall than is the second side of the body and (ii) the first motive element is driven at a speed less than the second motive element.

D. A method of operating an automatic swimming pool cleaner having a body and motive elements, comprising causing the body substantially to maintain contact with walls of a pool as it moves linearly along them.

E. A method according to statement D. in which the body substantially maintains contact with walls of the pool by having its motive elements driven in an unbalanced manner.

F. A method according to statement E. further comprising determining a shape and size of the pool based on information obtained by driving the motive elements in the unbalanced manner.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The foregoing is provided for purposes of illustrating, explaining, and describing embodiments of the present invention. Modifications and adaptations to these embodiments will be apparent to those skilled in the art and may be made without departing from the scope or spirit of the invention. Additionally, the word "pool" and phrase "swimming pool" as used herein may include vessels such as spas and hot tubs within their definitions.

What is claimed is:

1. A method of operating an automatic swimming pool cleaner within a swimming pool, comprising:

a. causing a body of the automatic swimming pool cleaner to travel along a surface of the swimming pool until the automatic swimming pool cleaner approaches a structural aspect of the swimming pool, the automatic swimming pool cleaner comprising a first motive element on a first side of the body and a second motive element on a second side of the body; and b. based on contact with the structural aspect, cause the first motive element or the second motive element proximate to the structural aspect to be driven at a first speed and cause the first motive element or the second motive element distal to the structural aspect to be driven at a second speed greater than the first speed.

2. A method according to claim 1 in which the structural aspect of the swimming pool is a wall and in which the act of driving the first motive element at a different speed than the second motive element causes the body to travel generally linearly along the wall.

3. A method according to claim 2 in which:

a. when the first side of the body is closer to the wall than is the second side of the body, the first motive element is caused to be driven at a speed less than the second motive element; and b. when the second side of the body is closer to the wall than is the first side of the body, the second motive element is caused to be driven at a speed less than the first motive element.

4. A method according to claim 3 further comprising causing determination of a characteristic of the swimming pool based on information obtained by having caused the first and second motive elements to be driven at different speeds.

5. A method according to claim 4 in which the characteristic is selected from a shape or a size of the swimming pool.

6. A method of operating an automatic swimming pool cleaner having a body and motive elements, comprising:

a. causing the body to move along a surface of a swimming pool; and b. causing the body substantially to maintain contact with a first wall of the swimming pool as it moves generally linearly along the first wall, wherein the act of causing the body substantially to maintain contact with a first wall of the swimming pool as it moves generally linearly along the first wall comprises causing the motive elements to be driven in an unbalanced manner.

7. A method according to claim 6, further comprising causing the body substantially to maintain contact with each of second, third, and fourth walls of the swimming pool as the body moves generally linearly along each of the second, third, and fourth walls, respectively.

* * * * *